US005327661A

United States Patent [19]

Orloff

[11] Patent Number: 5,327,661

[45] Date of Patent: Jul. 12, 1994

[54] METHOD AND APPARATUS FOR DRYING WEB

[75] Inventor: David I. Orloff, Atlanta, Ga.

[73] Assignee: Institute of Paper Science and Technology, Inc., Atlanta, Ga.

[21] Appl. No.: 702,841

[22] Filed: May 20, 1991

Related U.S. Application Data

[63] Continuation-in-part of Ser. No. 643,524, Jan. 18, 1991.

[51] Int. Cl.[5] ..... F26B 7/00

[52] U.S. Cl. ..... 34/388; 34/110; 162/289

[58] Field of Search ..... 34/110, 111, 112, 113, 34/12, 16; 162/202, 289, 280, 281, 282

[56] References Cited

U.S. PATENT DOCUMENTS 4,888,095 12/1989 Gulya et al. ..... 34/110

*Primary Examiner*—Henry A. Bennet

*Attorney, Agent, or Firm*—Fitch, Even, Tabin & Flannery

[57] ABSTRACT

The present invention is directed generally to a method and apparatus for drying a web of paper utilizing impulse drying techniques to provide a unique paper product having a predetermined pattern of delaminated paper fibers. In the method of the invention for drying a paper web, the paper web is transported through a pair of rolls wherein at least one of the rolls has been heated to an elevated temperature. The heated roll is provided with a planar surface having a predetermined pattern formed on the surface of a material having a low K value of less than about 3000 $w\sqrt{s}/m^2c$ and having a relatively low porosity. The material forming the predetermined pattern of the roll surface is preferably selected from the group consisting of ceramics, polymers, glass, inorganic plastics, composite materials and cermets. The remainder of the roll surface has a high K value of greater than about 3000. The material forming the remainder of the roll surface is preferably selected from steel, molybdenum, nickel and duralimin.

33 Claims, 2 Drawing Sheets

*Cross Section of Paper Impulse Dried Over Zirconium Oxide Surface*

*Cross Section of Paper Impulse Dried Over Steel Surface*

METHOD AND APPARATUS FOR DRYING WEB

RELATED APPLICATIONS

This application is continuation-in-part of application Ser. No. 643,524 filed Jan. 18, 1991.

FIELD OF THE INVENTION

The present invention relates generally to a method and apparatus for drying a wet paper web as it passes through the press nip of a pair of rolls in which one of the pair of rolls is heated to a high temperature in a manner such that a paper product is provided which has a predetermined pattern of delaminated paper fibers. More particularly, the present invention relates to impulse drying of a wet paper web through use of a heated roll having a planar surface having a predetermined pattern formed on the surface of a material having a low value of less than about 3000 for the quantity $K=\sqrt{\rho c\lambda}$.

BACKGROUND OF THE INVENTION

Impulse drying occurs when a wet paper web passes through the press nip of a pair of rolls in which one of the rolls is heated to a high temperature. A steam layer adjacent to the heated surface grows and displaces water from the sheet in a more efficient manner than conventional evaporative drying. It is projected that wide commercialization of impulse drying would result in very large industry wide energy savings.

Impulse drying is described in U.S. Pat. No. 4,324,613 to Wahren. Impulse drying is drying by means of heating one of a pair of rolls to a high temperature prior to passing a paper web between a pair of rolls. In the method of the Wahren patent, the surface of one of the rolls is heated to a high temperature by an external heat source immediately prior to passing the paper web between the heated roll and another roll. The Wahren patent describes the use of solid rolls having at least a surface layer having high thermal conductivity and high thermal diffusivity, such as copper or cast iron, for use as the heated roll.

The Wahren patent teaches that, in normal cases, a major part of the drying must take place in the press nip and final drying takes place after the nip. It is concluded the conductivity of the material of which the heating roll is made must be high so as not to dry at roll surface temperatures higher than necessary. A high conductivity means that the heat can be conducted to a greater depth in the roll and even extracted from a greater depth, which in itself means that a lower roll temperature can be used.

According to the Wahren patent, the choice of material is limited by the risk of thermal fatigue and, in this respect, at least the surface layer of the roll should be made of a material for which the quantity $$\frac{\sigma\mu(1-\nu)\sqrt{\rho}\ c\lambda}{Ea_c}$$

has a high value desirably at least $0.6\times10^6$, where $\sigma\mu$ is the fatigue strength, $\nu$ is Poisson's ratio, $\rho$ is the density, c is the specific thermal capacity, $\lambda$ is the thermal conductivity, E is the modulus of elasticity, and $a_c$ is the coefficient of thermal expansion for the material. Copper alloys have the highest values, approximately $1.3\times10^6$. However, they have rather poor resistance to wear and are not suitable for doctoring. Other suitable materials are duralumin ($0.7\times10^6$), cast iron ($0.67\times10^6$–$0.85\times10^6$), steel ($0.8\times10^6$) and nickel (approximately $0.8\times10^6$–$0.9\times10^6$).

Thus, the Wahren patent teaches the use of high conductivity surfaces, such as metal surfaces on the heated roll used in impulse drying. The Wahren patent does not teach or recognize the use of patterned rolls and does not teach or recognize the use of heated roll surfaces made from a material with a low value of the quantity $K=\sqrt{\rho c\lambda}$ such as are used in the heated roll of the present invention.

In addition to the impact on energy consumption, impulse drying also has an effect on paper sheet structure and properties. Surface fiber conformability and interfiber bonding are enhanced by transient contact with the hot surface of the roll. As the impulse drying process is usually terminated before the sheet is completely dried, internal flash evaporation results in a distinctive density profile through the sheet that is characterized by dense outer layers and a bulky midlayer. For many paper grades, this translates into improved physical properties. The persistent problem with the use of impulse drying, however, is that flash evaporation can result in delamination of the paper sheet. This is particularly a problem with heavy weight grades of paper. This has been a major constraint as to the commercialization of impulse drying.

It has been reported, Crouse, J. W., et al., "Delamination: A Stumbling Block to Implementation of Impulse Drying Technology for Liner Board", Tappi Engineering Conference, Atlanta, Ga., Sep. 13, 1989, that various degrees of delamination were experienced with liner board dried at press roll surface temperatures above 150° C. (300° F.). When delamination was avoided by operating at the lowest limit, water removal efficiencies were not significantly different than those obtained by conventional drying. It is concluded in this report that to realize the potential of impulse drying, it would be necessary to alleviate delamination.

In laboratory scale simulations, Lavery, H. P., "High Intensity Drying Processes-Impulse Drying Report", Three DOE/CE/407383-T3, Feb. 1988, it was found that increased pulp refining encouraged delamination and it was postulated that very thick or highly refined sheets exhibit greater resistance to the flow of vapor than thin or coarse paper webs. Hence, if the flow resistance of the web became so large that high pressure steam could not escape, the sheet may not be strong enough to sustain the pressurized vapor and delamination would occur.

The effect of hot surface materials on delamination has been investigated, Santkuyl, R. J., "The Effect of Hot Surface Material on Delamination in Impulse Drying", Master's Program, Institute of Paper Science and Technology, March, 1989. Using an electrohydraulic impulse drying simulator, carbon steel, aluminum and sintered porous stainless steel platens were tested in terms of their ability to dewater and suppress delamination. A felt back-up pad was used in the simulations. It was observed that a difference in K value between steel (K value of 15,000 $w\sqrt{s}/m^2c$) and aluminum (K value of 22,000 $w\sqrt{s}/m^2c$) had no affect on dewatering capacity or the propensity for paper sheets to delaminate. Porous stainless steel (K value of 3000 $w\sqrt{s}/m^2c$) platens provided completely suppressed delamination, although also providing considerable lower dewatering capacity. For porous materials, such as sintered porous stainless steel, a mass balance on the paper sheet showed that a large fraction of the water was removed as vapor and a much smaller fraction was displaced as liquid water into the backup felt. It was concluded that the porous platens do not operate by an impulse drying mechanism. Instead, steam formation and venting at the hot platen-vapor interface augmented by hot pressing were considered to be responsible for water removal. As a result of venting, measured temperatures within the vapor sheets never exceeded 100° C. (212° F.) and flash evaporation could not occur.

U.S. Pat. No. 3,296,710 to Krikorian is directed to the use of a porous absorbent layer on a roll to take up the water from the web. The water which is taken up in the pores of the porous roll is later evaporated by means of heating the porous layer. The use of a porous material is substantially different than the use of a solid material. The Krikorian patent is not related to the use of impulse drying. A porous material is not suitable for use as a roll for impulse drying since the porous material absorbs the moisture from paper in the nip of the rolls and such moisture is subsequently evaporated from the pores of the porous material.

Accordingly, it is a principal object of the present invention to provide a roll surface material which is suitable for use in impulse drying over a broad range of temperatures and nip residence times but wherein delamination of the paper web is prevented in certain areas but is caused to occur in other areas.

It is another object of the present invention to provide a roll surface material that can be heated for impulse drying and can attain efficiencies comparable to that of solid cast iron, copper or steel rolls but which do not result in delamination of the paper web in a predetermined area under high energy transfer conditions.

SUMMARY OF THE INVENTION

Figure 1:
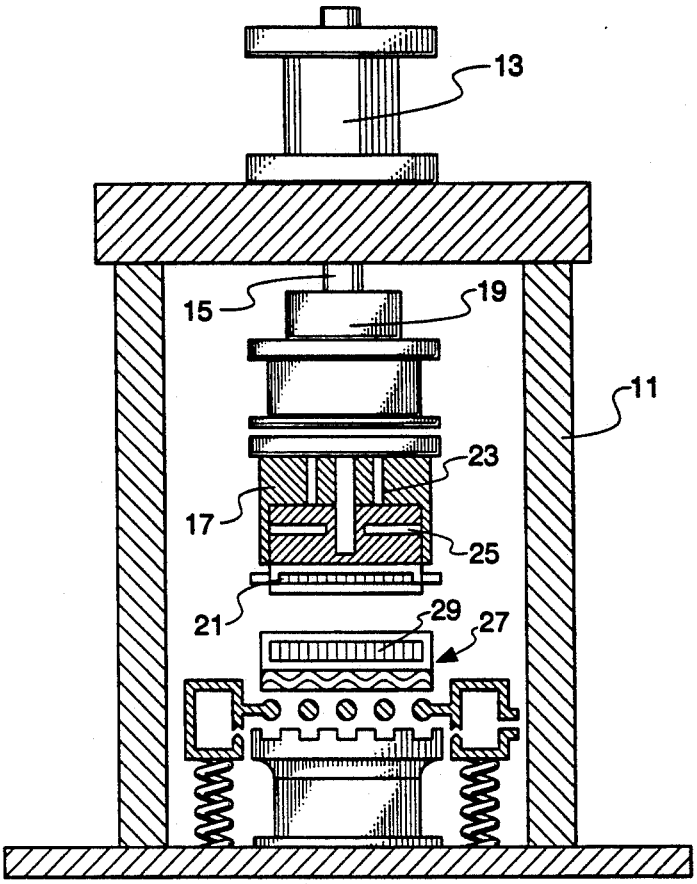
FIG. 1 is a schematic diagram of an electrohydraulic press that is designed to simulate impulse drying utilizing platens.

The present invention is directed generally to a method and apparatus for drying a web of paper utilizing impulse drying techniques to provide a unique paper product having a predetermined pattern of delaminated paper fibers. In the method of the invention for drying a paper web, the paper web is transported through a pair of rolls wherein at least one of the rolls has been heated to an elevated temperature. The heated roll is provided with a planar surface having a predetermined pattern formed on the surface of a material having a low K value of less than about 3000 $w\sqrt{s}/m^2c$ and having a relatively low porosity. The material forming the predetermined pattern of the roll surface is preferably selected from the group consisting of ceramics, polymers, glass, inorganic plastics, composite materials and cermets. The remainder of the roll surface has a high K value of greater than about 3000. The material forming the remainder of the roll surface is preferably selected from steel, molybdenum, nickel and duralumin.

DETAILED DESCRIPTION OF THE INVENTION

The present invention is directed to the discovery that the probability of delamination during impulse drying utilizing conventional roll surface materials can be utilized to provide a unique paper product with zones of delaminated paper fibers formed in accordance with a predetermined pattern. In accordance with the present invention, the K value of the surface of the heated roll is reduced in the area of a predetermined pattern to such an extent that the energy transferred to the paper web in the later stages of the impulse drying process is substantially reduced thereby reducing the energy available for flash evaporation in the pattern area and delamination is prevented in this area. The remaining area of the roll surface, having a high K value undergoes delamination and separation of the paper fibers to provide a delaminated zone. The resulting paper product remains laminated in a predetermined pattern area which passed over the low K value material.

In accordance with the invention, a roll is provided for use in impulse drying which has a surface having a predetermined pattern formed from a material having a low K value of less than about 3000 $w\sqrt{s}/m^2c$ and having a low porosity. Preferably, the K value of the material used to form the predetermined pattern is from about 100 $w\sqrt{s}/m^2c$ to about 3000 $w\sqrt{s}/m^2c$. The K value is the quantity $\sqrt{\rho c\lambda}$, where $\lambda$ is the thermal conductivity, $\rho$ is the density and c is the specific heat, which reduces to $w\sqrt{s}/m^2c$ where w is watts, s is seconds, m is meters and c is degrees Centigrade.

Low porosity is required for the entire surface of the heated roll to prevent absorption of water in the roll surface as the paper web passes between the heated roll and the unheated roll. In accordance with the present invention, the material used to form the predetermined pattern should have a porosity of less than about 10% by volume.

Suitable materials having a low K value and low porosity for providing the predetermined pattern or roll surface of the invention may be selected from the group consisting of ceramic, polymers, inorganic plastic, glass, composite materials and cermets.

Ceramics are non-metallic inorganic materials containing high proportions of silicon, silicon oxide, silicates, aluminum oxide, magnesium oxide, zirconium oxide and other metal oxides. One group of ceramics is prepared from mixtures of powders of clay, flint and feldspar. Triaxial ceramics are those prepared from the foregoing three components with occasional secondary fluxes, such as lime and magnesia. Non-triaxial ceramics contain other components such as talc, bone ash, pyrophyllite and alumina. One suitable type of ceramics are those having a high proportion of alumina or zirconia of above about 30%. Ceramics are formed by preparing a mixture of the ceramic powder with various amounts of water and thereafter forming the ceramic powder by slip casting, jiggering, drain casting, extrusion or pressing. Thereafter, the form is subjected to one or more heat processes to sinter the powder and form the solid ceramic. Ceramics can also be applied to a suitable substrate, such as a steel or aluminum roll, by a suitable method such as by plasma spraying. The solid ceramic surface has a porosity of less than about 10% by volume and preferably has a porosity of from about 1% to about 7% by volume.

Any suitable polymer can be used for the surface material of the roll of the invention which has a melting point in excess of 200° C. (392° F.). Suitable polymers can be selected by reference to a table of structural properties, such as that contained in the Encyclopedia of Modern Plastics, McGraw-Hill, Inc., mid-October, 1988 Issue, Vol. 65, No. 11, pp. 576–619. Representative polymeric products which are suitable for the surface material of the present invention include polyamides, polyacrylonitrile, polyester, fluoroplastics, such as polyetetrafluoroethylene, polychlorotri-fluoroethylene and fluorinated ethylene propylene, melamineformaldehyde, phenolics, such as melaminephenolic, polyesters, polyimides and sulfone polymers.

Any common glass, including ceramic glasses (Pyrocerams), can be used for the surface material of the roll of the invention. Common glass is essentially a sodium calcium silicate in composition. Potassium, barium, zinc, lead, alumina and boron are also often used in various amounts to provide particular properties. The ceramic glasses are produced from irradiated glass by heating them several hundred degrees above the temperature necessary for the development of opacity or color. Ceramic glasses have greater hardness and strength than common glass.

Suitable inorganic plastics include glass bonded mica, phosphol-asbestos compounds and calcium alumina-silicate compounds.

Cermets are a group of materials consisting of an intimate mixture of ceramic and metallic components. Cermets are fabricated by mixing finely divided components in the form of powders or fibers, compacting the components under pressure and sintering the compact to produce a material with physical properties not found solely in either of the components. Cermets can also be fabricated by internal oxidation of dilute solutions of a base metal and a more noble metal. When heated under oxidizing conditions, the oxygen diffuses into the alloy to form a base metal oxide in a matrix of the more noble material. Ceramic components may be metallic oxides, carbides, borides, silicides, nitrides or mixtures of these compounds. The metallic components include a wide variety of metals, such as aluminum, beryllium, copper, chromium, iron, silicon, molybdenum and nickel. Cermets can be applied to substrates by plasma spraying.

Cermets are one form of composite material. Other composite materials useful as the surface material on the roll of the present invention are those which are a matrix of a fiber or flake embedded in a suitable resin. The most commonly known form of composite material is fiberglass, which is a matrix of a glass fiber embedded in a polyester or epoxy resin. Other suitable fibers include those of boron and carbon.

The predetermined pattern of the material having a low K value may be formed by any suitable method. In one embodiment, a roll having a high K value surface, such as a steel roll, is machined to form grooves in the surface of the roll corresponding to the desired predetermined pattern of laminated paper. The grooves preferably have a depth of from about 1 mm to about 3 mm. A material having a low K value is then applied to the entire surface of the roll by a suitable method, such as plasma spraying. The roll surface is then treated by suitable machining techniques, such as grinding, so as to remove any of the low K value material which is applied over the high K value roll surface and to provide a smooth planar roll surface having the desired predetermined pattern of low K value material embedded in the grooves of the roll surface.

In another embodiment, a mask having apertures corresponding to the predetermined pattern is fitted over the surface of a roll. A material having a high K value is then applied through the apertures onto the surface of the roll by a suitable method, such as plasma spraying. The mask is removed and a material having a low K value is then applied to the roll surface. The low K value material overlaying the high K value material applied through the mask is removed by grinding or other method to provide a smooth surfaced roll having a predetermined pattern. Of course, the sequence of application of the high K value material and low K value material could be reversed.

The material forming the predetermined pattern may comprise several layers for enhanced performance. In this connection, high porosity ceramics having a porosity of greater than about 10% by volume have a lower K value than corresponding low porosity ceramics, having a porosity of less than about 10% by volume. High porosity ceramics, however, cannot be used as the sole material for the predetermined pattern on the roll surface intended for use in impulse drying, since such high porosity ceramics absorb moisture, as taught by U.S. Pat. No. 3,296,710 to Krikorian. In accordance with one embodiment of the present invention, a high porosity ceramic is used as an intermediate layer for its low K value in combination with an outer layer of a low porosity ceramic which is used for its relatively low K value and resistance to moisture absorption.

In this embodiment, a metallic coating may first be deposited directly onto the roll surface, either using the machined groove technique or the mask technique, prior to applying either the low porosity K value material or the intermediate high porosity K value material. Suitable metals for this coating are nickel alloys and molybdenum. The metal layer is optional but the metal layer enhances the adhesion of a high porosity ceramic coating to the roll and helps prevent corrosion of the roll. The thickness of the metal layer should be greater than 0.01 mm, and is preferably in the range of from about 0.01 mm to about 0.20 mm.

In this embodiment, a high porosity intermediate ceramic coating is formed over the metallic layer or directly on the roll if a first metallic layer is not used. Suitable ceramics for this intermediate ceramic layer include silicon oxide, titanium oxide, aluminum oxide and zirconium oxide. The thickness of this intermediate layer should be greater than 0.1 mm, and is preferably in the range of from about 0.1 mm to about 0.5 mm. The porosity should be greater than 10% by volume and is preferably in the range of from about 15% to about 90% by volume.

The layer of low porosity ceramic coating is deposited over the intermediate porous ceramic coating. The low porosity ceramic coating may be the same ceramic material as the intermediate porous ceramic material or may be different. Preferably, the low porosity ceramic layer is zirconium oxide or partially or fully stabilized zirconium oxide. The porosity of the low porosity ceramic layer is less than 10% by volume and is preferably in the range of from about 1% to about 7%.

The thickness of the outer low porosity ceramic layer is an important consideration to obtain optimum performance. The outer low porosity ceramic layer should be as thin as possible so that the physical properties of the outer low porosity ceramic layer do not obscure the low K value physical properties of the high porosity intermediate ceramic layer. In practical manufacturing terms, the outer low porosity ceramic layer cannot be made much thinner than about 0.02 mm. The maximum thickness of the outer low porosity ceramic layer should not be greater than about 0.10 mm to prevent such obscuring. Accordingly, the thickness after any machining steps should be less than about 0.10 mm, and is preferably in the range of from about 0.02 mm to about 0.10 mm. A high temperature hydrocarbon polymer sealant/release agent may be applied to the outer low porosity ceramic layer to enhance paper release and to seal any external pores in the outer ceramic layer.

The three coatings, i.e., the first metallic coating, the second high porosity ceramic coating and the third low porosity ceramic coating may be applied by any suitable method, such as by plasma spraying utilizing either the machined groove technique or the masking techniques to provide the predetermined pattern. Plasma spraying is a well known technique for applying coatings of metals and ceramics. Plasma spraying is described in U.S. Pat. No. 4,626,476 to Londry.

In the method of the present invention, a pair of rolls is used through which a paper web is transported. The surface of the roll having the predetermined pattern is heated to a temperature of from about 200° C. to about 500° C. The heated roll has a surface having a predetermined pattern formed from a low porosity material having a low K value of less than about 2000 $w\sqrt{s}/m^2c$ while the remainder of the surface is formed from a high K value material. The other roll is formed of a suitable material, such as steel or aluminum. In one embodiment, a web of a resilient material, such as felt, is interposed between the unheated roll and the paper web as it passes through the roll nip. In the practice of the method, the two rolls are urged together to provide a compressive force on the paper web as it is transported through the rolls. The residence time can be from about 10 to about 200 ms, preferably from about 20 to about 100 ms.

The method of the present invention is useful for the impulse drying of paper webs having an initial moisture level of from about 50% to about 70%. The moisture level of the paper web after being subjected to impulse drying in accordance with the invention will be in the range of from about 40% to about 60%. All percentages used herein are by weight, unless otherwise specified.

After drying, a paper product is obtained which is laminated in the area of the paper which passed over the predetermined pattern which is formed from a low K value material and is delaminated in that area which passed over the material having a high K value. The ability to provide a paper product having areas of laminated and delaminated paper may be used to provide unique paper products, such as the manufacture of patterned paper towels, embossed paper and the manufacture of a paper replacement for plastic bubble wrap.

The following examples further illustrate various features of the invention, but are intended to in no way limit the scope of the invention which is defined in the appended claims.

EXAMPLE 1

Figure 2:
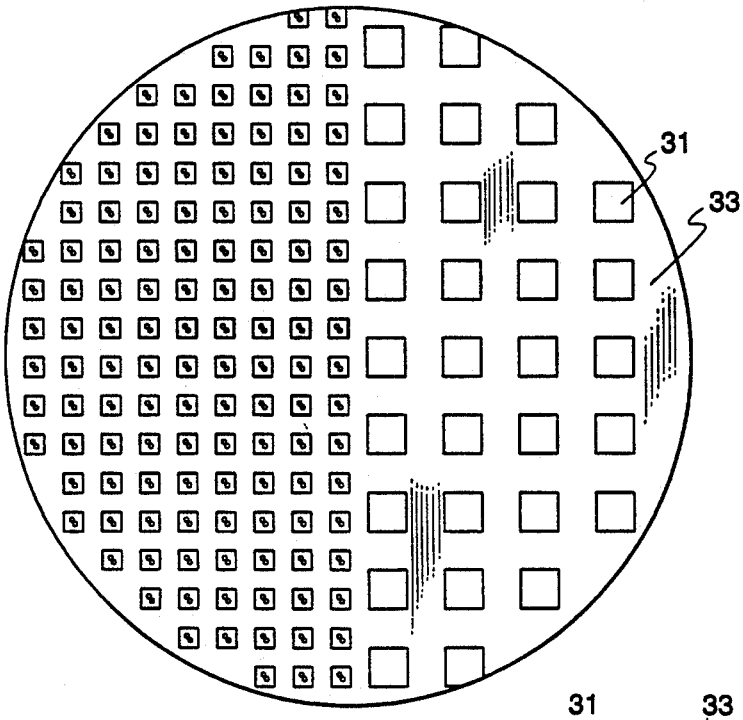
FIG. 2 is a top view of a platen for use in the press of FIG. 1 having a predetermined pattern of a material having a low K value formed therein.
Figure 3:
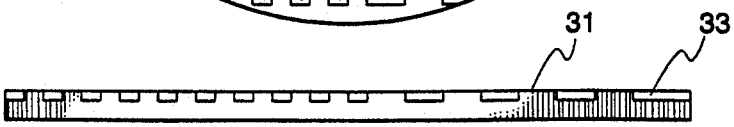
FIG. 3 is a cross sectional view of the platen of FIG. 1 taken along the line 3—3.

Laboratory scale impulse drying simulations were carried out utilizing the apparatus depicted in FIG. 1. The apparatus includes a frame 11 on which is mounted a hydraulic cylinder 13. The piston 15 of the hydraulic cylinder 13 actuates a heating head 17 through a load cell 19. A heating platen 21 is disposed at the lower extremity of the heating head 17. Heaters 23 are disposed within the heating head 17 for heating the platen 21. A thermocouple 25 is disposed in the heating head for measuring the surface temperature of the platen surface 21. A stand 27 holds a felt pad 29 against which the heating head is actuated by the hydraulic cylinder 13. In the following impulse drying simulations, the heating platen was a steel platen 31 which had been machined to form 1.5 mm deep grooves corresponding to the pattern shown in FIG. 2. After machining, the platen was plasma sprayed with zirconium oxide to fill the grooves. The platen was machined to remove any zirconium oxide overlying the steel to form a planar surface with alternating areas of steel and zirconium oxide 33, as shown in FIGS. 2 and 3. The ceramic material was fully stabilized zirconium oxide having a K value of 2000 $w\sqrt{s}/m^2c$.

The surface of the heterogeneous platen was designed to have equal ceramic and steel surface area. The water removal induced by the platen was expected to be the sum of water removed by each area.

The basic objective of the experiment was to show that regions of the handsheet beneath the steel would delaminate while regions beneath the ceramic would not. Z-direction ultrasound was used to quantify delamination. A $\frac{3}{8}$ inch diameter transducer was used to record z-directional specific elastic modulus at thirty locations per sheet. Fifteen locations were directly under the $\frac{1}{4}$ inch square steel sites, while fifteen locations were directly under ceramic sites. Previous research has shown that the onset of sheet delamination corresponds to an abrupt increase in the coefficient of variation of the specific elastic modulus. Hence, delamination under steel sites was observed when the site temperature exceeded 200° C., while delamination under the ceramic site was not observed until the site temperature exceeded 250° C.

Visual observation of the sheets confirmed the ultrasound findings. No visible delamination was noted at average surface temperatures below 165° C. For average surface temperatures between 165° C. and 250° C., sheets visibly delaminated only in regions of the sheet in direct contact with the steel sites of the platen. At average surface temperatures in excess of 250° C., large regions of the sheets exposed to both ceramic and steel showed signs of visible delamination.

Figure 4:
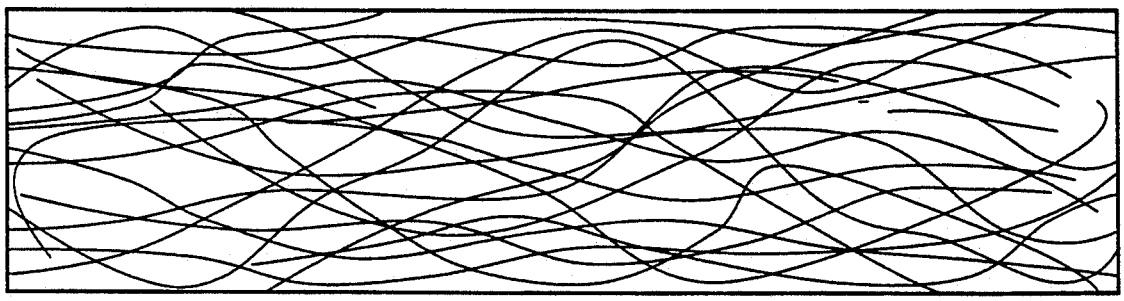
FIG. 4 is a pictorial representation of a photomicrograph of a paper hand sheet showing lamination of the paper at the preselected regions of the paper; which overlay the predetermined pattern of the platen of FIG. 2 during heating.
Figure 5:
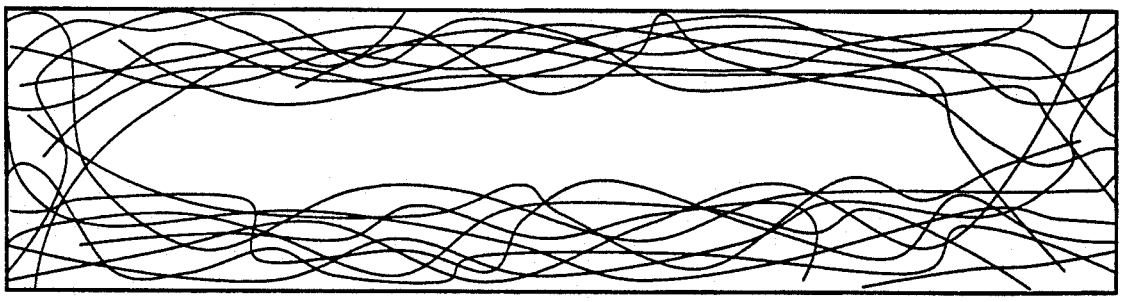
FIG. 5 is a pictorial representation of a photomicrograph showing delamination of the paper at the regions of the paper which overlay the remainder of the platen.

FIGS. 4 and 5 are representations of photomicrographs of cross sections through regions of typical sheets in contact with steel (FIG. 5) and with ceramic (FIG. 4) at two different platen surface temperatures. The micrographs confirm that delamination occurred in regions of the sheet in contact with steel but not in regions in contact with ceramic.

The photomicrographs show that sheet properties such as bond strength and bulk can be engineered into sheets at specific localized regions. The ability to develop patterned web structure may have application in a number of paper and non-woven markets.

What is claimed is:

1. A method for impulse drying a web of paper to provide a paper product having a predetermined pattern of delaminated paper fibers comprising transporting a paper web through a pair of rolls wherein the surface of at least one of said rolls has been heated to an elevated temperature, said heated roll having a planar surface having a predetermined pattern formed on said surface of a material having a low K value of less than about 3000 $w\sqrt{s}/m^2c$ and having a low porosity, the remainder of said surface having a high K value of greater than about 3000 $w\sqrt{s}/m^2c$.

2. A method in accordance with claim 1 wherein said predetermined pattern has a K value of from about 100 to about 3000 $w\sqrt{s}/m^2c$.

3. A method in accordance with claim 1 wherein said predetermined pattern of said heated roll is formed from a material selected from the group consisting of ceramic, polymers, glass, inorganic plastics, composite materials and cermets.

4. A method in accordance with claim 3 wherein said predetermined pattern of said heated roll is formed from a ceramic.

5. A method in accordance with claim 4 wherein said ceramic has a porosity of less than about 10% by volume.

6. A method in accordance with claim 4 wherein said ceramic has a porosity of from about 1% to about 7% by volume.

7. A method in accordance with claim 1 wherein said elevated temperature is from about 200° C. to about 500° C.

8. A method in accordance with claim 1 wherein said unheated roll has a resilient surface and said pair of rolls are urged together to provide a compressive force on said paper web.

9. A method in accordance with claim 8 wherein said compressive force is from about 0.3 MPa to about 10 MPa.

10. A method in accordance with claim 1 wherein the residence time of said paper in the nip of said rolls is from about 10 to about 200 ms.

11. A method in accordance with claim 1 wherein the moisture content of said paper web prior to passing through said rolls is from about 50% to about 70% by weight.

12. A method in accordance with claim 1 wherein said predetermined pattern is formed by applying a first metallic coating to said roll, applying a second high porosity ceramic coating onto said first metallic coating and applying a third low porosity ceramic coating onto said porous ceramic coating.

13. A method in accordance with claim 12 wherein the thickness of said first metallic coating is from about 0.1 mm to about 0.20 mm.

14. A method in accordance with claim 12 wherein the porosity of said second ceramic coating is from about 15% to about 90% by volume.

15. A method in accordance with claim 12 wherein the thickness of said second porous ceramic layer is from about 0.12 mm to about 0.5 mm.

16. A method in accordance with claim 12 wherein the thickness of said third dense ceramic coating is from about 0.2 mm to about 0.10 mm.

17. A method in accordance with claim 12 wherein the porosity of said third ceramic coating is from about 1% to about 7% by volume.

18. A method in accordance with claim 12 wherein said high porosity ceramic coating is applied directly to said metal roll without applying said first metallic coating.

19. A method in accordance with claim 12 wherein the ceramic used for said high porosity ceramic coating and for said low porosity ceramic coating is selected from the group consisting of zirconium oxide, silicon oxide, titanium oxide, aluminum oxide and mixtures thereof.

20. A roll for use as the heated roll utilized in impulse drying of a web of paper to provide a paper product having a predetermined pattern of delaminated paper fibers, said roll having a planar surface having a predetermined pattern formed on said surface of a material having a low K value of less than about 3000 $w\sqrt{s}/m^2c$ and having a low porosity, the remainder of said surface having a high K value of greater than about 3000 $w\sqrt{s}/m^2c$.

21. A roll in accordance with claim 20 wherein said predetermined pattern K value is from about 100 to about 3000 $w\sqrt{s}/m^2c$.

22. A roll in accordance with claim 20 wherein said predetermined pattern of said heated roll is a material selected from the group consisting of ceramic, polymers, glass, inorganic plastics, composite materials and cermets.

23. A roll in accordance with claim 22 wherein said predetermined pattern of said heated roll is formed from a ceramic.

24. A roll in accordance with claim 23 wherein said ceramic has a porosity of less than about 10% by volume.

25. A roll in accordance with claim 23 wherein said ceramic has a porosity of from about 1% to about 7% by volume.

26. A roll in accordance with claim 20 wherein said heated roll having a predetermined pattern is formed by applying a first metallic coating to said roll, applying a second high porosity ceramic coating to said first metallic coating and applying a third low porosity ceramic coating to said porous ceramic coating.

27. A roll in accordance with claim 26 wherein the thickness of said first metallic coating is from about 0.1 mm to about 0.20 mm.

28. A roll in accordance with claim 26 wherein the porosity of said second ceramic coating is from about 15% to about 90% by volume.

29. A roll in accordance with claim 26 wherein the thickness of said second porous ceramic layer is from about 0.1 mm to about 0.5 mm.

30. A roll in accordance with claim 26 wherein the thickness of said third dense ceramic coating is from about 0.02 mm to about 0.10 mm.

31. A roll in accordance with claim 26 wherein the porosity of said third ceramic coating is from about 1% to about 7% by volume.

32. A roll in accordance with claim 26 wherein said high porosity ceramic coating is applied directly to said metal roll without applying said first metal coating.

33. A roll in accordance with claim 26 wherein the ceramic used for said high porosity ceramic coating and for said low porosity ceramic coating is selected from the group consisting of zirconium oxide, silicon oxide, titanium oxide, aluminum oxide and mixtures thereof.

* * * * *